US006702143B2

(12) United States Patent
Wang

(10) Patent No.: US 6,702,143 B2
(45) Date of Patent: Mar. 9, 2004

(54) CONTAINER

(75) Inventor: Soo chang Wang, Seoul (KR)

(73) Assignee: Korea Alphaline Co. Ltd., Seoul (KR)

( * ) Notice: Subject to any disclaimer, the term of this patent is extended or adjusted under 35 U.S.C. 154(b) by 80 days.

(21) Appl. No.: 10/110,255

(22) PCT Filed: Nov. 13, 2001

(86) PCT No.: PCT/KR01/01933

§ 371 (c)(1),
(2), (4) Date: Apr. 8, 2002

(87) PCT Pub. No.: WO02/40356

PCT Pub. Date: May 23, 2002

(65) Prior Publication Data

US 2003/0066838 A1 Apr. 10, 2003

(30) Foreign Application Priority Data

Nov. 14, 2000 (KR) ..... 2000-67565

(51) Int. Cl.[7] ..... B65D 6/26
(52) U.S. Cl. ..... 220/666; 215/900; 206/218
(58) Field of Search ..... 220/666, 667, 220/9.2; 215/900; 206/218

(56) References Cited

U.S. PATENT DOCUMENTS 2,780,378 A * 2/1957 Romano ..... 215/11.1
3,083,877 A * 4/1963 Gash ..... 222/107
3,557,788 A * 1/1971 Swartz ..... 604/195
5,209,372 A * 5/1993 Norwood ..... 220/666
5,370,250 A * 12/1994 Gilbert ..... 222/1
5,638,995 A 6/1997 Mazda
5,683,369 A 11/1997 Tsukada
5,921,466 A 7/1999 Speese et al.
6,105,815 A 8/2000 Mazda
6,305,546 B1 10/2001 Saunders et al.
6,554,149 B2 * 4/2003 Schneider et al. ..... 220/9.3

FOREIGN PATENT DOCUMENTS

WO WO 99/26847 6/1999

* cited by examiner

*Primary Examiner*—Joseph Man-Fu Moy
(74) *Attorney, Agent, or Firm*—Roth & Goldman, P.A.

(57) ABSTRACT

Disclosed herein is a container (1), which is easily contracted and elastically expanded to restore its original shape by a coil spring (7). This container (1) includes a flexible body (3) and a capacity control ring (5). The body (3) has a cylindrical interior for containing something. The capacity control ring (5) is spirally formed around the outer surface of the sidewall of the body (3), and allows the body (3) to be contracted and elastically expanded in a vertical direction, thus controlling the capacity of the body (3).

8 Claims, 4 Drawing Sheets

CONTAINER

TECHNICAL FIELD

The present invention relates generally to containers, and more particularly, to a container, which is easily contracted to reduce its capacity and elastically expanded to restore its original capacity.

BACKGROUND ART

Generally, containers may contain something which is not transformed in shape or reduced in quantity regardless of consumption, but usually contain something which is reduced in volume as it is consumed. In the case of containing liquid food in the container, as a user drinks the liquid, the food in the container is decreased in quantity and empty space in the container becomes larger. Due to such an increased empty space, the container is inefficient in terms of its space utilization. In addition, since the container with the increased empty space undesirably maintains its original volume, it is inconvenient for a user to carry the container.

In order to solve the above problem, as shown in FIG. 4, a collapsible container has been proposed and widely used to contain liquid material. A plurality of annular folding lines are formed around the circumferential surface of the container at regular intervals. The folding lines are designed to allow the collapsible container to be expanded or contracted at the folding lines in a zigzag mode so as to appropriately control the capacity of the container. That is, when a large quantity of material is required to be contained in the container, a user pulls up on the container for increasing its capacity. On the other hand, when the quantity of contents is decreased, the user presses down on the container for reducing its capacity.

Such a collapsible container is advantageous in that its capacity can be controlled. However, this container has a problem that it doesn't have a restoring force in itself for restoring its original shape, so a user has to manually pull up on or press down on the container when necessary, thus being complicated to control the capacity of the container. Furthermore, the conventional collapsible container has another problem that it is inferior in terms of hygiene, since dirt may be caught in the channels, formed inside the container along the folding lines, during containing something in the container, and the dirt can hardly be removed from the container due to the bellows shape of the collapsible container.

DISCLOSURE OF THE INVENTION

Accordingly, the present invention has been made keeping in mind the above problems occurring in the prior art, and an object of the present invention is to provide a container, which is easily expanded or contracted and ensures the easy removal of dirt.

In order to accomplish the above object, an embodiment of the present invention provides a container, including a flexible body having a cylindrical interior for containing something, and a capacity control ring spirally formed around the outer surface or inner surface of the sidewall of the body, and allowing the body to be contracted and expanded in a vertical direction thereof, thus controlling the capacity of the body.

It is preferable that the capacity control ring have a hollow passage interiorly formed along the ring, and a coil spring received in the hollow passage and providing an elasticity to the body for allowing the contraction and expansion of the body. It is also preferable that the capacity control ring be a solid ring.

It is further preferable that a spiral collapsible groove be formed on the sidewall of the body along a spiral channel formed between turns of the capacity control ring.

It is still further preferable to have a lid closing the mouth of the body and having an air valve for allowing air to be discharged from the interior of the body.

In order to accomplish the above object, another embodiment of this present invention provides a container, including a flexible body having a cylindrical interior for containing something, a seat groove spirally formed around the sidewall of the body, a coil spring set along the seat groove and providing an elasticity to the body for allowing elastic contraction and expansion of the body, a collapsible groove spirally formed around the sidewall of the body along a spiral land formed between turns of the seat grove for allowing the body to be easily contracted and expanded, and a lid closing the mouth of the body and having an air valve for allowing air to be discharged from the interior of the body.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
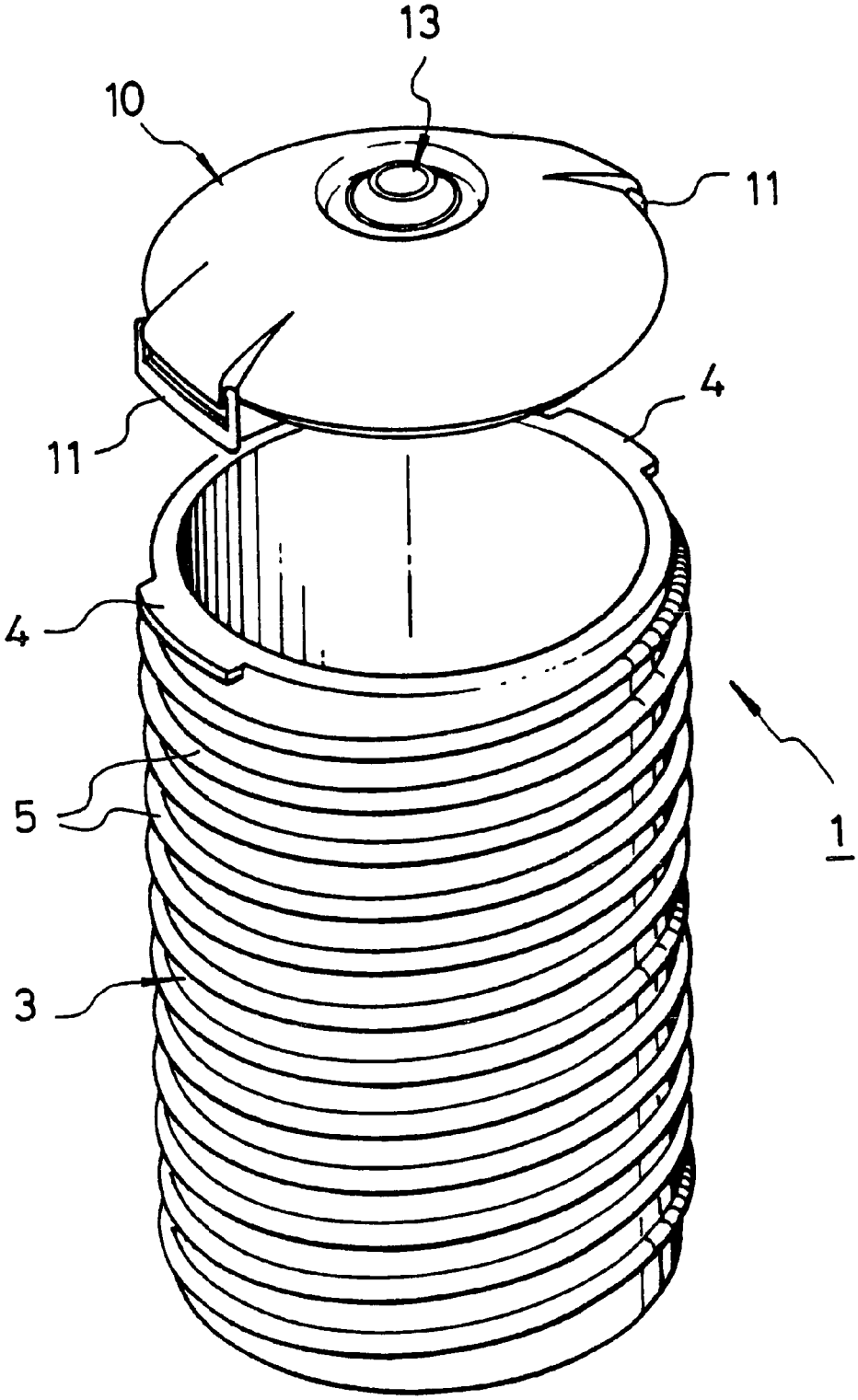
FIG. 1 is a perspective view showing a container according to the primary embodiment of this invention, when a lid of the container is opened.

Reference should now be made to the drawings, in which the same reference numerals are used throughout the different drawings to designate the same or similar components.

Figure 2:
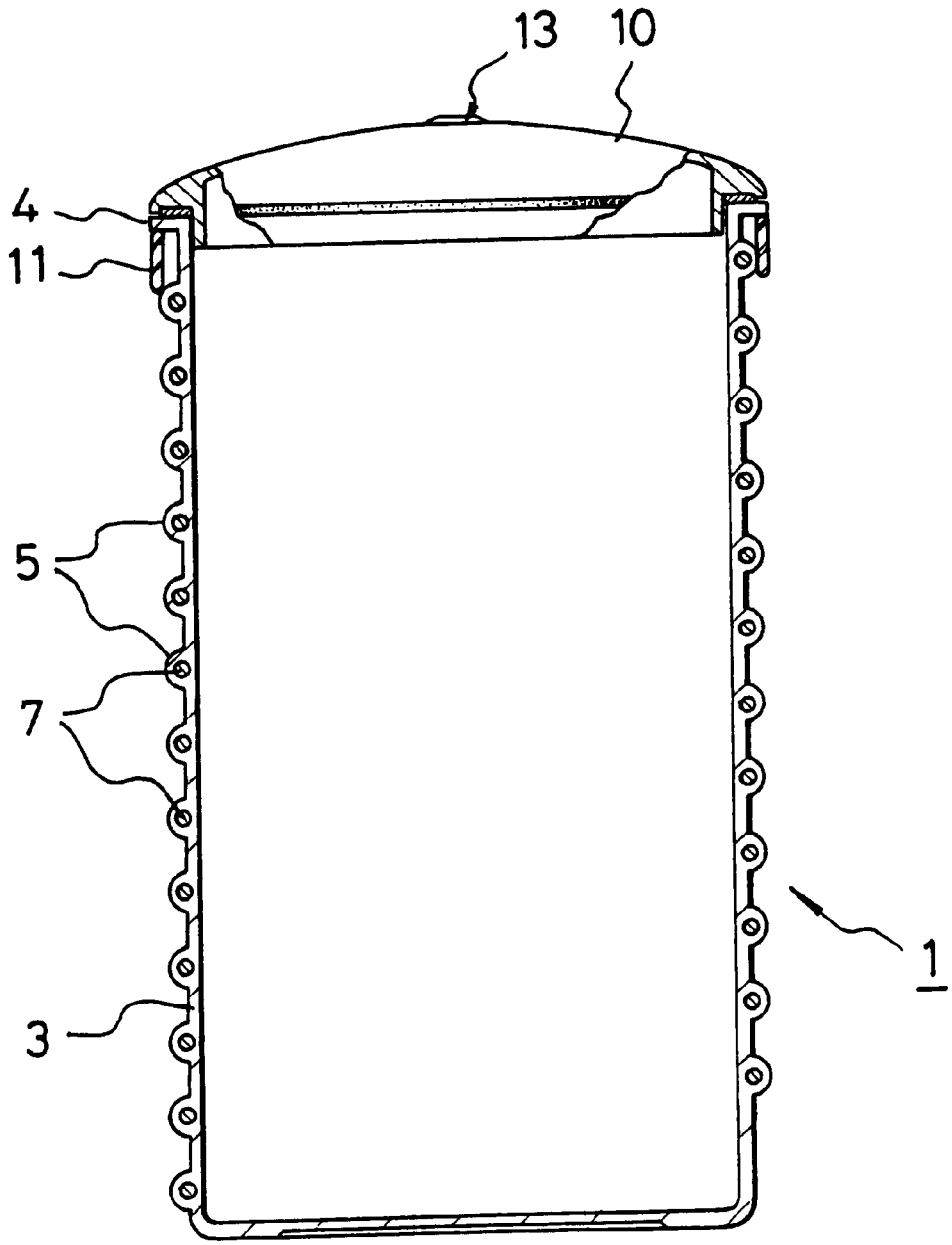
FIG. 2 is a sectional view of the container according to the primary embodiment of this invention, when the lid is closed.

According to the primary embodiment of this invention, as shown in FIGS. 1 and 2, a container 1 includes a body 3 and a lid 10 airtightly closing the body 3.

The body 3 is formed in a cylindrical shape, and provided along the edge of its mouth with a plurality of locking projections 4 at diametrically opposite positions. The locking projections 4 are used to lock the lid 10 to the body 3, in addition to functioning as a handle of the container. A capacity control ring 5 is spirally formed around the outer surface of the sidewall of the body 3, while extending from the top to the bottom of the body 3. This capacity control ring 5 is used to contract and expand the body 3.

The capacity control ring 5 is protrusively formed on the outer surface of the sidewall of the body 3 in a spiral direction. The capacity control ring 5 has a semicircular cross-section, and is provided in its interior with a hollow passage 6. A coil spring 7 normally having a predetermined spring force is received in the hollow passage 6.

Thus, when contracting the body 3 in a vertical direction, a spiral channel formed between turns of the capacity control ring 5 is folded, so the capacity of the body 3 becomes smaller. However, in a normal condition, the spring force of the coil spring 7 is applied to the body 3, thus keeping the body 3 at a vertically expanded state.

The lid 10 is used to close the body 3, and has a dome-shaped appearance. A plurality of locking rings 11 are installed along the edge of the lid 10. The locking rings 11 have a square shape, and are locked to the locking projections 4, respectively. The lid 10 is provided on its center portion with an air valve 13, which is disclosed in Korean Utility Model Registration No. 88100 applied by and allowed to the inventor of this invention.

The process of containing something in the container 1 of this invention is as follows. First, the user puts something in the body 3 and puts the lid 10 on the body 3. Thereafter, the user locks the lid 10 to the body 3 by fitting the locking rings 11 over the locking projections 4. When the quantity of material contained in the container 1 is smaller than that of the body 3, the user presses down the body 3 to contract it. By this operation, the capacity of the body 3 is reduced to meet the volume of the contents in the container 1.

When contracting the body 3 in this way, air is discharged from the interior of the container 1 through the air valve 13 provided on the lid 10, thus accomplishing airtight sealing of the container 1. Therefore, the capacity of the container 1 can be controlled to an appropriate minimum level which is required to contain something. In addition, the container 1 can keep contents, such as food or drink, fresh for a lengthy period of time in the airtightly sealed state.

In the case of where it is required to take the contents out the container 1, the user pushes the air valve 13 down such that atmospheric air flows into the container 1. While air flows into the container 1, the body 3 is vertically and elastically expanded by the spring force of the coil spring 7. When the body 3 is completely expanded and restores its original shape, it is possible to take the contents out the container 1 after removing the lid 10 from the body 3.

As such, according to this invention, the flexible body 3 is designed to be collapsible for controlling the capacity of the container 1. When it is required to reduce the capacity of the body 3, the user has to directly press down the body 3 to collapse it. But, when it is required to return the body 3 to its original shape, the user manipulates the air valve 13 to allow atmospheric air to flow into the body 3 through the air valve 13, thus easily expanding the body 3 without manually expanding it. Therefore, it is very easy to control the capacity of the body 3. Normally, the body 3 maintains its original shape, that is, an extended shape, thus easily removing the dirt caught in the folded channel while containing something in the container 1, therefore being excellent in terms of hygiene. Furthermore, by using the air valve 13, food and drink can be freshly contained in the capacity controllable container 1 for a lengthy period of time in the vacuum state.

Figure 3A:
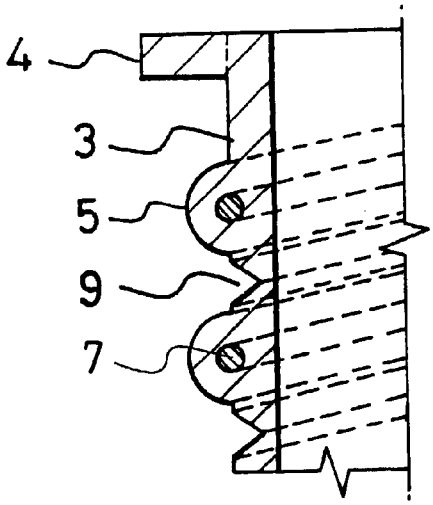
FIGS. 3*a* to 3*d* are sectional views of containers according to the other embodiments of this invention.

According to another embodiment of this invention, as shown in FIG. 3*a*, a collapsible groove 9 is spirally formed around the outer surface of the sidewall of the body 3 along a spiral channel formed between turns of the capacity control ring 5 and cut in such a way as to have a V-shaped cross-section. The collapsible groove 9 is formed from the top to the bottom of the body 3 along the spiral channel. Thus, when pressing down the body 3, the body 3 is folded along the collapsible groove 9. Therefore, the body 3 can be folded with a small force, thus allowing a user to easily fold the body 3.

Figure 3B:
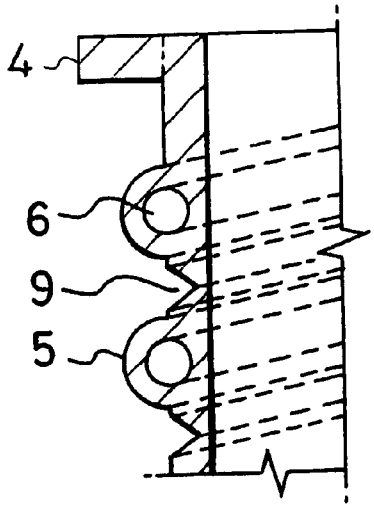

In the above embodiments of this invention, a coil spring 7 is received in the hollow passage 6 of the capacity control ring 5. However, as shown in FIG. 3*b*, the container 1 may be designed to have only the hollow passage 6, without the coil spring 7. In this case, since,the capacity control ring 5 serves as a coil spring, the body 3 can be contracted as well as expanded to its original shape by only guiding air into the airtightly sealed body 3, similarly to the above embodiments provided with the coil spring 7.

Figure 3C:
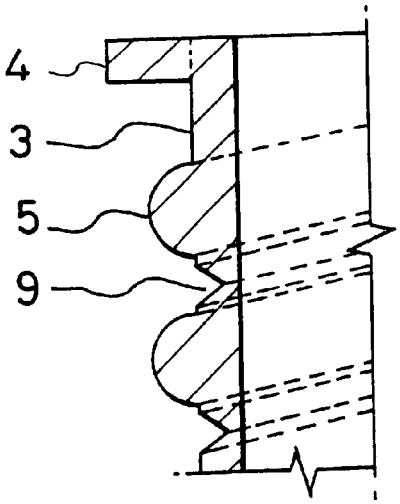
Figure 3D:
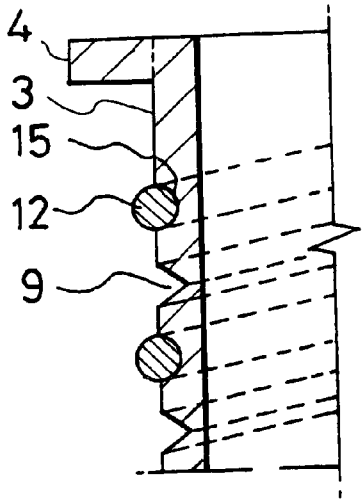
Figure 4:
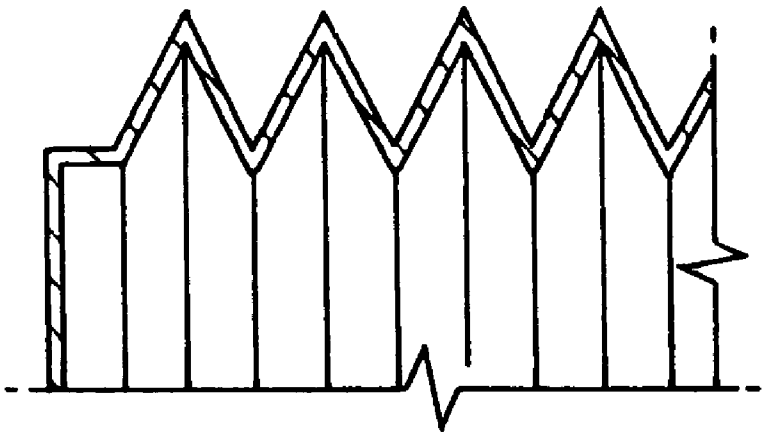
FIG. 4 is a sectional view of a conventional collapsible container.

Furthermore, as shown in FIG. 3*c*, it is possible to design the container 1 to have a solid ring 5 without such a hollow passage 6, different from the embodiment shown in FIG. 3*b*. According to still another embodiment of this invention, as shown in FIG. 3*d*, a seat groove 15 is spirally formed around the sidewall of the body 3 and receives a coil spring 12 therein for allowing contraction and elastic expansion of the body 3, thus it is easy to manufacture the container 1.

INDUSTRIAL APPLICABILITY

As described above, the present invention provides a container, which has a lid provided with an air valve, thereby being convenient to control the capacity of the container, easy to clean and keeping food and drink fresh for a lengthy period of time.

What is claimed is:

1. A container, comprising:

a flexible body having a closed end and sidewalls forming a cylindrical interior having a capacity for containing material introduced through a mouth formed at an open end of said flexible body;

a lid, removably coupled to the open end of said flexible body, to close the mouth of said flexible body and thereby create an airtight seal for the cylindrical interior;

a capacity control ring, formed as a spring extending from the closed end to the open end of said flexible body, to control the capacity of said flexible body by selectively compressing and releasing said capacity control ring, said capacity control ring being spirally formed around a circumferential surface of the sidewalls of said flexible body and having a predetermined spring force allowing said flexible body to be axially contracted and extended, such that said flexible body can be in one of a fully extended state and a contracted state depending on a desired capacity; and an air valve, installed in said lid, to allow air to be discharged from the cylindrical interior of said flexible body when said flexible body is axially contracted.

2. The container as claimed in claim 1, wherein, when said air valve is closed, the state of said flexible body is maintained.

3. The container as claimed in claim 2, wherein said capacity control ring has a spring force sufficient to place said flexible body in a fully extended state when said air valve is opened.

4. The container as claimed in claim 3, wherein, when said flexible body is in the fully extended state, said flexible body has a smooth inner surface.

5. The container as claimed in claim 1, wherein said capacity control ring has a seat groove integrally formed with the circumferential surface of said flexible body, running spirally from the closed end to the open end of said flexible body.

6. The container as claimed in claim 5, wherein the seat groove has a semicircular cross-section.

7. The container as claimed in claim 6, wherein the diameter of the semicircular cross-section is less than the diameter of the seat groove, such that the coil spring protrudes from the circumferential surface of said flexible body.

8. The container as claimed in claim 1, wherein said capacity control ring is formed by a seat groove integrally formed with the circumferential surface of said flexible body, running spirally from the closed end to the open end of said flexible body, and a coil spring seated in the seat groove of said capacity control ring, wherein said flexible body has a collapsible groove spirally formed in the circumference surface, the collapsible groove being interlaced with respect to each turn of the capacity control ring, to facilitate contraction of said flexible body, and wherein said capacity control ring has a spring force sufficient to place said flexible body in a fully extended state when said air valve is opened, whereby said flexible body has a smooth inner surface.

* * * * *